US007992264B2

(12) United States Patent
Abadi

(10) Patent No.: US 7,992,264 B2
(45) Date of Patent: Aug. 9, 2011

(54) MAGNETIC CLOSURE

(76) Inventor: Joseph Abadi, Panama (PA)

( * ) Notice: Subject to any disclaimer, the term of this patent is extended or adjusted under 35 U.S.C. 154(b) by 0 days.

(21) Appl. No.: 11/441,298

(22) Filed: May 25, 2006

(65) Prior Publication Data

US 2006/0265841 A1 Nov. 30, 2006

Related U.S. Application Data

(60) Provisional application No. 60/684,371, filed on May 26, 2005.

(51) Int. Cl.
*A44B 99/00* (2010.01)
*A41D 25/00* (2006.01)
*A44B 1/04* (2006.01)

(52) U.S. Cl. ..... 24/303; 24/3.13; 24/49.1

(58) Field of Classification Search ..... 24/1.1–49.1, 24/56, 60–64, 66.1, 66.4–66.7, 66.11, 66.13, 24/303
See application file for complete search history.

(56) References Cited

U.S. PATENT DOCUMENTS 2,319,292 A * 5/1943 Boggs ..... 24/303
2,483,031 A * 9/1949 Avedon ..... 24/104
2,592,395 A * 4/1952 Cummings ..... 24/66.1
2,601,424 A * 6/1952 Baker ..... 24/66.1
2,648,884 A * 8/1953 Loofboro ..... 24/303
2,975,497 A * 3/1961 Budreck ..... 24/303
3,141,216 A * 7/1964 Haskell ..... 24/303
3,161,932 A * 12/1964 Russell ..... 24/303
3,378,893 A * 4/1968 Labek ..... 24/303
3,499,192 A * 3/1970 Holtz ..... 24/66.6
3,827,019 A * 7/1974 Serbu ..... 292/251.5
4,099,300 A 7/1978 Wolak
4,123,824 A * 11/1978 Roberts ..... 24/66.6
4,126,917 A 11/1978 Nakatsuji
4,184,231 A * 1/1980 Konnan ..... 24/49.1
4,399,595 A * 8/1983 Yoon et al. ..... 24/303
4,622,726 A * 11/1986 Nakamura ..... 24/303
5,007,139 A * 4/1991 Ahern ..... 24/66.2
5,050,276 A * 9/1991 Pemberton ..... 24/303
5,097,569 A * 3/1992 Erickson ..... 24/66.6
5,682,648 A * 11/1997 Miller ..... 24/5
5,732,451 A * 3/1998 Mars ..... 24/303
5,802,678 A 9/1998 Puente
6,216,275 B1 4/2001 Lee
6,282,760 B1 * 9/2001 Mars ..... 24/303
6,367,126 B1 * 4/2002 Rivkin ..... 24/3.3
6,434,801 B2 * 8/2002 Grunberger ..... 24/303
6,484,424 B1 11/2002 Peterson
6,626,009 B1 * 9/2003 Ohlund ..... 63/3.1
2003/0154576 A1 * 8/2003 Mirharooni ..... 24/41.1
2006/0032026 A1 * 2/2006 Schoening et al. ..... 24/66.1
2006/0236509 A1 * 10/2006 Ausman ..... 24/303

* cited by examiner

*Primary Examiner* — Robert J Sandy

(57) ABSTRACT

A clasp, including a first magnet, a second magnet, wherein the clasp is closed by coupling the first magnet and the second magnet and the clasp is opened by uncoupling the first magnet and the second magnet.

8 Claims, 4 Drawing Sheets

MAGNETIC CLOSURE

The present application claims benefit under 35 U.S.C. §119(e)(1) to U.S. provisional application 60/684,371, filed May 26, 2005, the entirety of which is herein incorporated by reference.

FIELD OF THE INVENTION

The present invention relates to clothing.

BACKGROUND

A traditional tie pin prevents the tie of the wearer of the tie pin from slipping to awkward angles while allowing the tie a degree of mobility. In addition, the traditional tie pin embellishes the visual appeal of the tie. However, a traditional tie pin includes a pin that pierces through the tie leaving a hole each time that it is used, damaging the tie and adversely impacting its appearance. A traditional tie clip does not damage a tie; however, it suffers from the disadvantages of being bulky, rendering the tie completely immobile at the point of attachment of the tie clip, and being less attractive in the opinion of many tie wearers. It would therefore be desirable to provide a tie pin that did not damage a tie.

SUMMARY OF THE INVENTION

A clasp, including a first magnet, a second magnet, wherein the clasp is closed by coupling the first magnet and the second magnet and the clasp is opened by uncoupling the first magnet and the second magnet.

DETAILED DESCRIPTION OF THE PREFERRED EMBODIMENTS

The following definitions are provided to aid in construing the claims of the present application:

Decorative Form: A housing having an ornamental shape, such as a geometric shape, comprising an oval, a square, a triangle, a square, a circle, a rectangle, or a diamond, a flower, a butterfly, a flag, or other shape.

Decorative Surface: A surface containing any decoration, including, but not limited to, a geometric shape, such as an oval, a square, a triangle, a square, a circle, a rectangle, or a diamond, a geometric design, a crest or coat of arms (such as a family or school crest or coat of arms), a company or brand insignia, logo, or trademark, or a design including school, club, military unit, or national colors, emblems, flags, or symbols.

False Cuff Link: A device that (1) covers a shirt cuff button and button hole when worn, (2) that appears to be a cuff link when worn, and (3) that functions as a cuff link for a non-French cuff shirt when worn.

T-Shaped End: A metal, plastic, or other component in the shape of a straight or curved "T", anchor, or double-ended hook.

Tie Clasp: A device for holding a wearer's tie in place.

Figure 1:
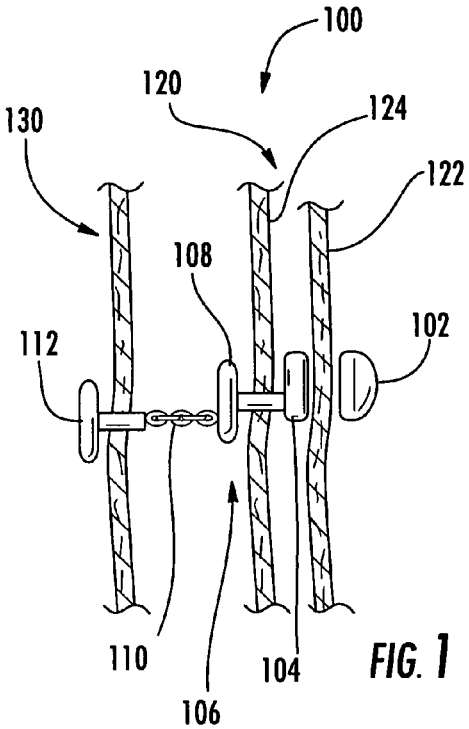
FIG. 1 is an illustration of a first embodiment of the present invention.

Referring to FIG. 1, in a first preferred embodiment, tie pin 100 includes outer magnet 102, inner magnet 104, piercing pin 106, pin base 108, chain 110, and T-shaped end 112. Outer magnet 102 and inner magnet 104 are preferably strong magnets in order to allow the outer magnet 102 and inner magnet 104 to be of sufficiently small size. Suitable magnets can be purchased from the Rochester Magnets and Stanford Magnets companies. Outer magnet 102 and inner magnet 104 are preferably surrounded by housings constructed of metal, plastic, or other materials, which can be decorative in nature. One or more of such housings can include one or more decorative surfaces. Alternatively, or in addition, one or more of such housings can be shaped into a decorative form. Piercing pin 106 is preferably a sharp pin that can be constructed of any type of metal, such as brass, aluminum, or stainless steel, or other materials. Piercing pin 106 is attached to pin base 108, which is preferably constructed of the same material as piercing pin 106 and can form a "T" shape in combination with piercing pin 106. Chain 110 can be a metal chain constructed of brass, aluminum, or stainless steel, or can be constructed of other materials and is attached to both pin base 108 and T-shaped end 112. T-shaped end 112 can be constructed of brass, aluminum, or stainless steel, or can be constructed of other materials. Also illustrated in FIG. 1 are tie 120 comprised of front end 122 and rear end 124 and shirt 130. Tie 120 can be any available necktie, whether made of silk, wool, synthetic, or other materials, or a combination of materials. Shirt 130 can be any shirt, such as a men's dress shirt, whether made of silk, cotton, synthetic, or other materials, or a combination of materials. Shirt 130 can, but need not, be a button down shirt.

In a first preferred embodiment, T-shaped end 112 is placed with the cross-piece of the "T" inside a wearer's shirt button hole with the end of the "T" protruding, together with chain 110, which is attached to T-shaped end 112. Piercing pin 106, attached to pin base 108, attached in turn to chain 110, is placed through tie rear end 124 and attached to inner magnet 104, such as by screwing piercing pin 106 into inner magnet 104, sliding piercing pin 106 into a groove in inner magnet 104, or by other means. Tie front end 122 is then placed in front of inner magnet 104 and finally outer magnet 102 is placed in front of tie front end 122 so as to couple outer magnet 102 with inner magnet 104.

Outer magnet 102 and inner magnet 104 when coupled together hold tie front end 122 in place without creating any unsightly holes in tie front end 122. Outer magnet 104, piercing pin 106, and pin base 108 together hold tie rear end 124; although a hole is created in tie rear end 124 by piercing pin 106, such hole is not visible when the tie is worn because tie rear end 124 is concealed behind tie front end 122. Pin base 108, chain 110, and T-shaped end 112 together form a connection to the wearer's shirt.

In other embodiments, other components can be substituted for T-shaped end 112. For example, a second pair of magnets can be used in lieu of T-shaped end 112. The second pair of magnets can be attached to the two sides of the wearer's shirt. Alternatively, a second pin can be substituted for T-shaped end 112. This second pin can be attached to the wearer's shirt. Alternatively, a clip can be substituted for T-shaped end 112. This clip can be attached to the wearer's shirt. In other embodiments, yet other components can be substituted for T-shaped end 112.

In other embodiments, pin base 108 can be omitted and chain 110 attached directly to piercing pin 106. In other embodiments additional components can be utilized.

Figure 2:
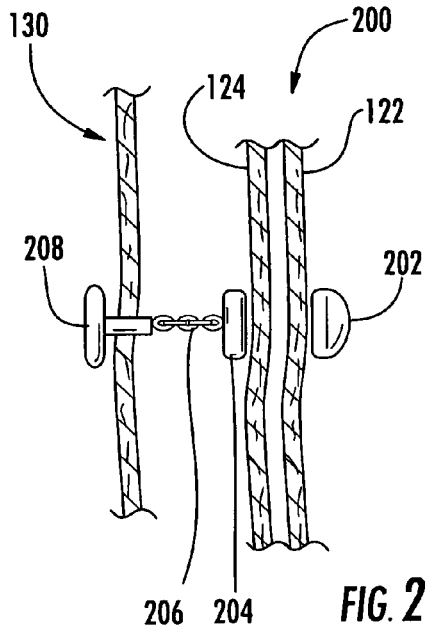
FIG. 2 is an illustration of a second embodiment of the present invention.

Referring to FIG. 2, a second preferred embodiment of the present invention is illustrated. Ttie pin 200 includes outer magnet 202, inner magnet 204, chain 206, and T-shaped end 208. Outer magnet 202 and inner magnet 204 are preferably strong magnets in order to allow the outer magnet 202 and inner magnet 204 to be of sufficiently small size. Outer magnet 202 and inner magnet 204 are preferably surrounded by housings constructed of metal, plastic, or other materials, which can be decorative in nature. One or more of such housings can include one or more decorative surfaces. Alternatively, or in addition, one or more of such housings can be shaped into a decorative form. Chain 206 can be a metal chain constructed of brass, aluminum, or stainless steel, or can be constructed of other materials and is attached to both inner magnet 204 and T-shaped end 208. T-shaped end 208 can be constructed of brass, aluminum, or stainless steel, or can be constructed of other materials. Also illustrated in FIG. 2 are tie 120 comprised of front end 122 and rear end 124 and shirt 130. Tie 120 can be any available necktie, whether made of silk, wool, synthetic, or other materials, or a combination of materials. Shirt 130 can be any shirt, such as a men's dress shirt, whether made of silk, cotton, synthetic, or other materials, or a combination of materials. Shirt 130 can, but need not, be a button down shirt.

In a first preferred embodiment, T-shaped end 208 is placed with the cross-piece of the "T" inside a wearer's shirt button hole with the end of the "T" protruding, together with chain 206, which is attached to T-shaped end 208. Chain 206 is also attached to inner magnet 204. First tie rear end 124 and then tie front end 122 are placed in front of inner magnet 204 and finally outer magnet 202 is placed in front of tie front end 122 so as to couple outer magnet 202 with inner magnet 204.

Outer magnet 202 and inner magnet 204 when coupled together hold both tie front end 122 and tie rear end 124 in place without creating any unsightly holes in tie 120. Chain 206 and T-shaped end 208 together form a connection to the wearer's shirt. Although this second preferred embodiment requires a somewhat stronger pair of inner and outer magnets in order to hold a wearer's tie as securely as the first embodiment, it offers the advantages of (1) not creating any holes whatsoever in a wearer's tie, (2) being simpler for a wearer to use (having fewer pieces or steps—there is no risk that a neophyte wearer will mistakenly pierce the front of his tie), (3) requiring less time to use when dressing in the morning, and (4) having fewer and simpler parts to manufacture, thereby reducing its cost.

In other embodiments, other components can be substituted for T-shaped end 208. For example, a second pair of magnets can be used in lieu of T-shaped end 208. The second pair of magnets can be attached to the two sides of the wearer's shirt. Alternatively, a pin can be substituted for T-shaped end 208. This pin can be attached to the wearer's shirt. Alternatively, a clip can be substituted for T-shaped end 208. This clip can be attached to the wearer's shirt. In other embodiments, yet other components can be substituted for T-shaped end 208. In other embodiments additional components can be utilized.

Figure 3:
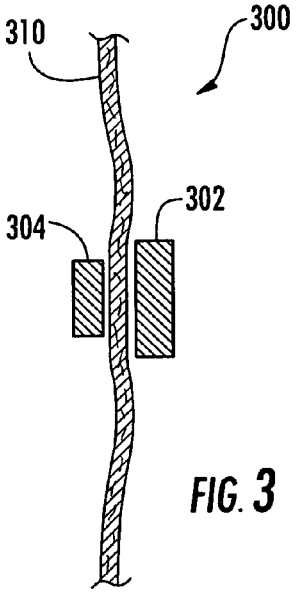
FIG. 3 is an illustration of a third embodiment of the present invention.

Referring to FIG. 3, a third preferred embodiment of the present invention is illustrated. Pin 300 is comprised of inner magnet 302 and outer magnet 304. Blouse 310 is also illustrated. Blouse 130 can be any shirt, dress, sweater, hat, or similar garment, such as a lady's blouse, whether made of silk, cotton, synthetic, or other materials, or a combination of materials. Outer magnet 302 and inner magnet 304 are preferably strong magnets in order to allow the outer magnet 302 and inner magnet 304 to be of sufficiently small size. Outer magnet 302 and inner magnet 304 are preferably surrounded by housings constructed of metal, plastic, or other materials, which can be decorative in nature. In particular, the outer surface of outer magnet 302 can resemble a decorative broach, hatpin, or other ornamental pin.

Inner magnet 302 and outer magnet 304 are coupled together on either side of blouse 310 so as to hold pin 300 in place. Thus, no unsightly holes are made in blouse 310.

Figure 4:
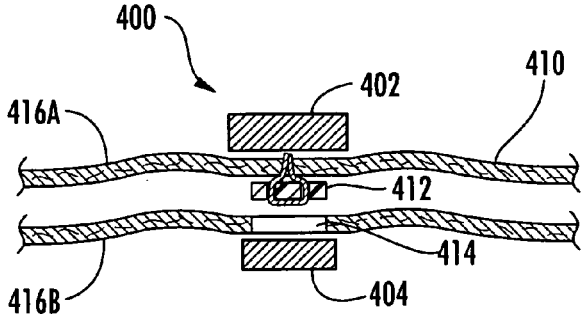
FIG. 4 is an illustration of a fourth embodiment of the present invention.
Figure 5:
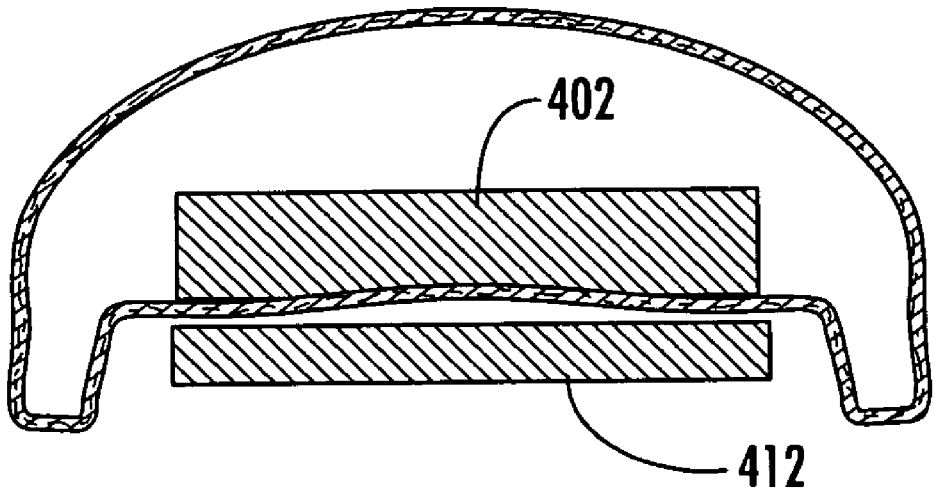
FIG. 5 is an illustration of a component usable in conjunction with a fourth embodiment of the present invention.

Referring to FIG. 4, a fourth preferred embodiment of the present invention is illustrated. False cuff link 400 includes first magnet 402 and second magnet 404. First magnet 402 and second magnet 404 are preferably strong magnets in order to allow the outer magnet 302 and inner magnet 304 to be of sufficiently small size. Outer magnet 302 and inner magnet 304 are preferably surrounded by housings constructed of metal, plastic, or other materials, which can be decorative in nature. In particular, the housings of first magnet 402 and second magnet 404 can be constructed so as to resemble cuff links. The housing of at least one of first magnet 402 and second magnet 404 preferably contains a hollow space of sufficient size to allow a shirt button to be inserted into it. FIG. 5 illustrates such a housing with respect to first magnet 402, although, such a housing could alternatively be utilized for both first magnet 402 and second magnet 404. Shirt cuff 410 includes button 412, button hole 414, and cuff ends 416A and 416B. Shirt cuff 410 is one cuff of a standard non-French cuff long sleeve shirt.

False cuff link 400 is utilized by unbuttoning button 412 and aligning cuff end 416A with cuff end 416B as if shirt cuff 410 were a French cuff. First magnet 402 is placed over button 412 and second magnet 404 is placed under button hole 414 so that any housings surrounding first magnet 402 and second magnet 404 face outward and first magnet 402 and second magnet 404 are coupled and hold cuff end 416A and cuff end 416B securely between them. Ordinarily a false cuff link would be worn by a user on each of the user's right and left cuffs. Thus, two sets of first and second magnets would be necessary. This embodiment provides the advantage of allowing a wearer to utilize the same shirt both with and without cuff links. This can be desirable for those who are uncertain as to whether they desire to spend considerable sums of money to acquire French cuffs shirts that they may not wear regularly. It can also be desirable for individuals who desire to project the appearance of having a large wardrobe on limited finds by wearing the same shirts sometimes as French cuffs and sometimes not.

Figure 6:
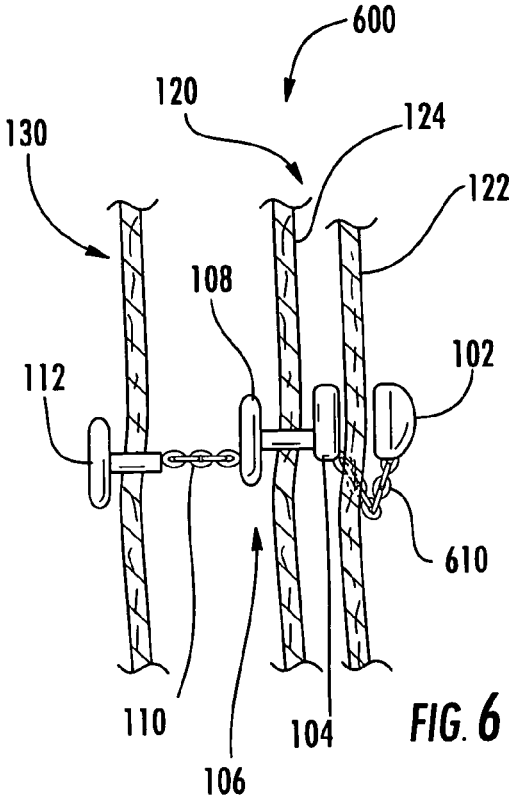
FIG. 6 is an illustration of a fifth embodiment of the present invention.

FIG. 6 illustrates a sixth embodiment of the present invention. FIG. 6 is identical in all respects to the embodiment illustrated in FIG. 1, except that chain 610 is attached to both inner magnet 104 and to outer magnet 102. Chain 610 must be sufficiently long so as to loop around tie 120 without causing tie 120 to be bent or crumpled by chain 610. Chain 610 must also be sufficiently strong so as to be able to hold outer magnet 102 (including any attached housing) without breaking, yet not be so heavy as to cause tie 120 to buckle.

Chain 610 provides the benefit that if outer magnet 102 becomes dislodged while tie pin 600 is being worn, outer magnet 102 remains attached to chain 610 and is not lost.

Chain 610 also provides a different aesthetic appearance to the present invention that can be more appealing to some users.

Figure 7:
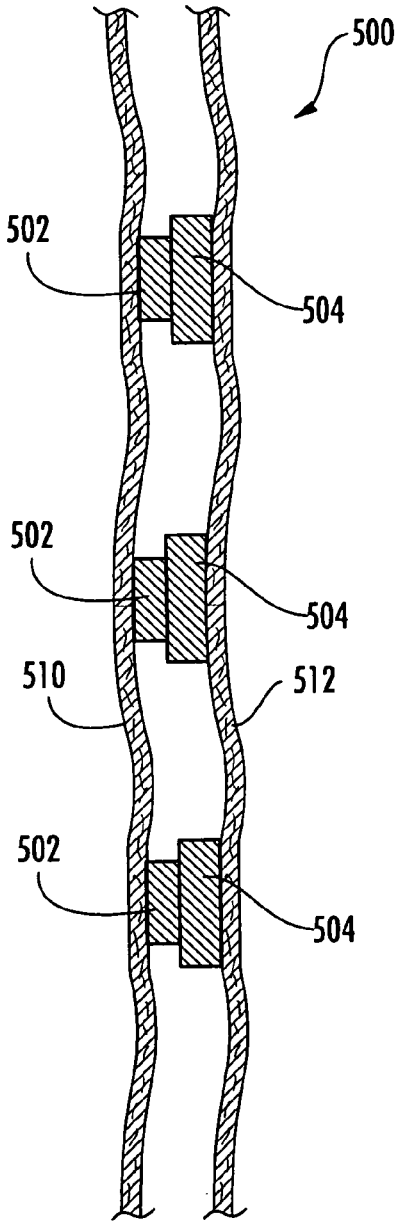
FIG. 7 is an illustration of a sixth embodiment of the present invention.
Figure 8:
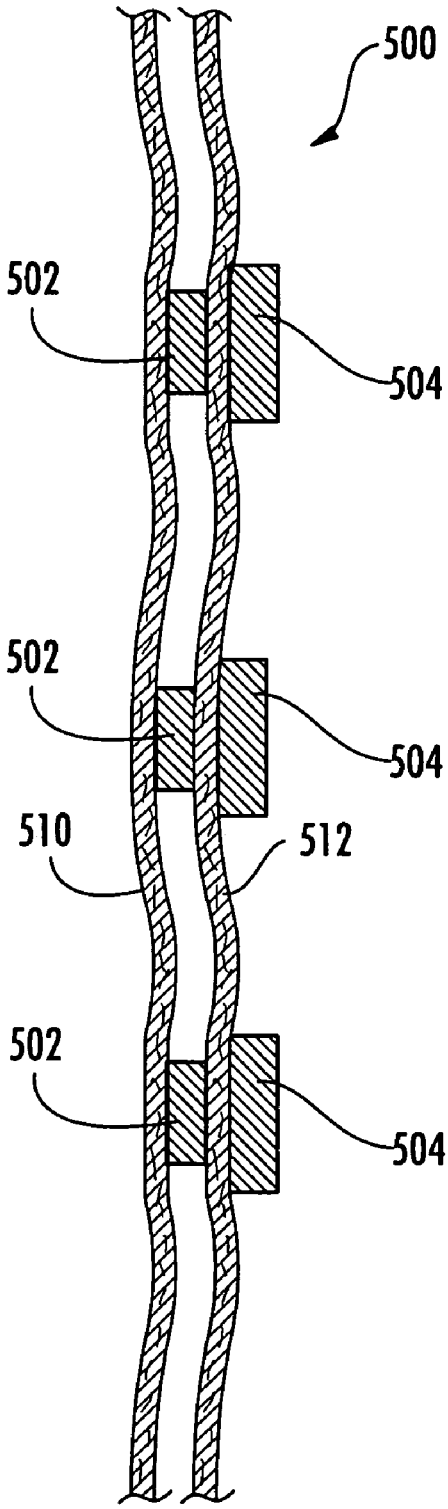
FIG. 8 is an illustration of a seventh embodiment of the present invention.

In the embodiments illustrated in FIGS. 7 and 8, the present invention can be utilized to provide magnetic shirt buttons. A pair of magnets can function as a button, with one magnet on the outside of the shirt and one on the inside; when coupled together, the two magnets can hold together two layers of fabric and hold closed a portion of a wearer's shirt. By using multiple pairs of magnets, such as three, four, five, or more, such magnets can function in place of buttons. In some embodiments, one set of magnetic buttons is attached to a shirt where ordinary buttons would ordinarily be attached and the corresponding set of magnetic buttons is attached to the same shirt where button holes would ordinarily be located on the shirt. Magnetic buttons can be easier to use than ordinary buttons for the young, elderly, and especially those suffering from disabilities affecting their hands or fine motor movements.

For example, referring to FIG. 7, a series of magnets 502 can be attached to the upper side of the side of a shirt in which button holes are ordinarily inserted 510 and a series of magnets 504 can be attached to the underside of a the side of a shirt to which buttons are ordinarily attached 512. Such magnetic buttons can easily be closed merely by lining up the two sets of buttons 502 and 504 adjacent to each other and allowing magnetic forces to close the magnetic buttons or opened by grasping the two sides of the shirt 510 and 512 and pulling the two sides apart.

FIG. 8 illustrates an embodiment identical to that illustrated in FIG. 7 except that magnets 504 are located on the upper surface of shirt side 512. Such placement allows the use of decorative housings for magnets 504 that would not be visible in the embodiment illustrated in FIG. 7.

The present invention may be embodied in other specific forms without departing from the spirit or essential attributes of the invention. Accordingly, reference should be made to the appended claims, rather than the foregoing specification, as indicating the scope of the invention.

That which is claimed is:

1. A clasp comprising:
a first magnet;
a second magnet;
a first chain attached to said first magnet and said second magnet;
a pin removably connected to said second magnet;
a second chain attached to said pin; and
a T-shaped end attached to said second chain,
wherein said clasp is closed by coupling said first magnet and said second magnet; and
wherein said clasp is opened by uncoupling said first magnet and said second magnet.

2. The clasp of claim 1, wherein at least one of said first magnet and said second magnet comprises a decorative surface.

3. The clasp of claim 1, wherein said clasp is a tie clasp.

4. A clasp comprising:
a first magnet;
a second magnet;
a first chain attached to said first magnet and said second magnet; and
an attachment assembly,
wherein said clasp is closed by coupling said first magnet and said second magnet;
wherein said clasp is opened by uncoupling said first magnet and said second magnet; and
wherein said attachment assembly comprises a pin removably connected to said second magnet, a second chain attached to said pin, and a clip attached to said second chain.

5. A clasp comprising:
a first magnet;
a second magnet;
a first chain attached to said first magnet and said second magnet; and
an attachment assembly,
wherein said clasp is closed by coupling said first magnet and said second magnet;
wherein said clasp is opened by uncoupling said first magnet and said second magnet; and
wherein said attachment assembly comprises a pin removably connected to said second magnet, a second chain attached to said pin, and a second pin attached to said second chain.

6. A clasp comprising:
a first magnet;
a second magnet;
a first chain attached to said first magnet and said second magnet; and
an attachment assembly,
wherein said clasp is closed by coupling said first magnet and said second magnet;
wherein said clasp is opened by uncoupling said first magnet and said second magnet; and
wherein said attachment assembly comprises a pin removably connected to said second magnet, a second chain attached to said pin, a third magnet, and a fourth magnet, and said third magnet is attached to said second chain.

7. A clasp comprising:
a first magnet; a second magnet;
a first chain attached to said first magnet and said second magnet; and
an attachment assembly,
wherein said clasp is closed by coupling said first magnet and said second magnet;
wherein said clasp is opened by uncoupling said first magnet and said second magnet; and
wherein said attachment assembly comprises a second chain attached to said second magnet, and a clip attached to said second chain.

8. A clasp comprising:
a first magnet;
a second magnet;
a first chain attached to said first magnet and said second magnet; and
an attachment assembly,
wherein said clasp is closed by coupling said first magnet and said second magnet;
wherein said clasp is opened by uncoupling said first magnet and said second magnet; and
wherein said attachment assembly comprises a pin removably connected to said second magnet, a third magnet, and a fourth magnet, and said third magnet is attached to said pin.

* * * * *